United States Patent [19]

Pole

[11] 4,326,476

[45] Apr. 27, 1982

[54] NAVIGATION IN ICE COVERED WATERWAYS

[75] Inventor: Charles D. Pole, Willowdale, Canada

[73] Assignee: Upper Lakes Shipping Ltd., Toronto, Canada

[21] Appl. No.: 104,699

[22] Filed: Dec. 17, 1979

[51] Int. Cl.[3] ..... B63B 35/08

[52] U.S. Cl. ..... 114/40

[58] Field of Search ..... 114/40, 41, 42

[56] References Cited

U.S. PATENT DOCUMENTS

| | | | |
|---|---|---|---|
| 3,521,591 | 7/1970 | Alexander | 114/41 |
| 3,636,904 | 1/1972 | Blanchet | 114/41 |
| 4,208,977 | 6/1980 | Jahns et al. | 114/40 |

FOREIGN PATENT DOCUMENTS

| | | | |
|---|---|---|---|
| 1175103 | 6/1964 | Fed. Rep. of Germany | 114/40 |
| 2212145 | 9/1973 | Fed. Rep. of Germany | 114/40 |
| 316229 | 11/1971 | U.S.S.R. | 114/40 |

*Primary Examiner*—Ralph J. Hill

*Attorney, Agent, or Firm*—Alan Swabey; Robert Mitchell; Guy Houle

[57] ABSTRACT

A navigation channel is made in the ice covering the surface of a waterway by propelling a vessel so that its bow breaks the ice to form a channel having a width of the beam of the ship and an auxiliary channel is similarly formed at each side of the ship in rear of its bow to provide leeway for the ship to turn. As the ship is turned, the auxiliary channel is enlarged by breaking the ice on the edge of the auxiliary channel toward the stern of the ship to give it greater leeway to turn. The auxiliary channel may be broken out by fin means projecting from the side of the ship effective to exert forward, upward and outward force against the ice blanket to break pieces from it.

17 Claims, 15 Drawing Figures

FIG.5.
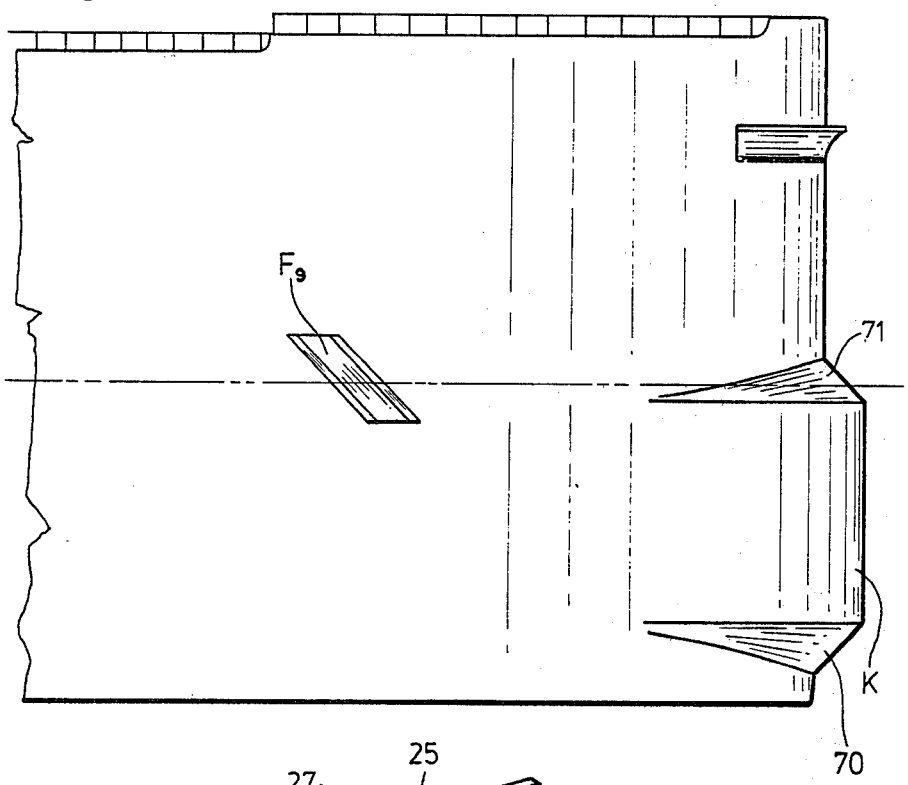
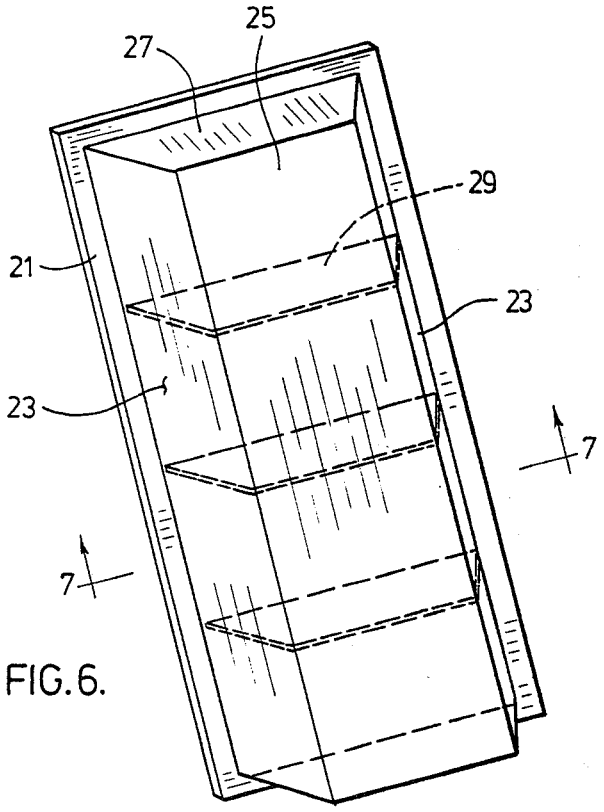
FIG.6.

NAVIGATION IN ICE COVERED WATERWAYS

BACKGROUND OF THE INVENTION (1) Field of the Invention

This invention relates to ice displacement to facilitate winter navigation, particularly of elongated lake ships.

(2) Description of Prior Art

The desirability of navigation in northern climates, during as much of the year as possible, is accentuated by the tremendous capital cost of building large lake ships of the type customarily employed on the Great Lakes, and the energy shortage making ground transportation more expensive than ever.

U.S. Pat. No. 3,791,328 Schirtzinger (1974) mentions the revival of interest in expedients for cutting ice to permit the passage of vessels through icebound areas and describes means for making an ice removal track. The patent also talks about prior art expedients disclosed in U.S. Pat. Nos. 3,521,529 Rosner et al (1970) and U.S. Pat. No. 3,636,904 Blanchet (1972). These expedients would not be practical for general application to conventional vessels over normal cargo routes which have to conform to rigid standards, since this rules out radical changes in construction.

The progress of a conventional vessel through ice is dependent mainly on the thickness and type of ice; the thrust of the propeller or propellers; the shape of the hull, with particular emphasis on the forward section; and friction between the hull of the vessel and the ice. Should any of the above factors change or be changed then the vessel's performance would change. The ability of a vessel to steer, when operating in ice, is dependent principally on the thickness and characteristics of the ice; the shape of the bow section; the shape of the stern section; the thrust of the propeller and size of the rudder; and possibly of greatest influence, the length of parallel body (straight ship sides). So, although most vessels, other than ice breakers, have trouble in navigating in ice covered waterways, some have a lot more trouble than others, and this difficulty is proportionately increased with ship length.

The influence of a ship's side length on the ability of a ship to navigate in ice is discussed, in some detail, in *Influence of Major Characteristics of Icebreaker Hulls on their Powering Requirements and Manoeuverability in Ice* by R. Y. Edwards, Jr., R. A. Major, J. K. Kim, J. G. German, J. W. Lewis, and D. R. Miller, appearing in the Journal of the Society of Naval Architecture Marine Engineers No. 12, 1976. This is a paper presented at the Annual Meeting of the Society, in New York, on Nov. 11 to 13, 1976, which is hereby incorporated by reference. The tests of two models are discussed which differed only in the length of the parallel middle body. One model was 20% longer than the other. The predicted turning radius per unit ship length of each of the two models was plotted versus rudder angle, for an approach speed of 6 knots. The turning radius of the longer ship was significantly greater than that of the shorter model. The turning radius per unit of ship length was 10.4 for the longer model and 3.0 for the shorter model at a rudder angle of 35°. An increase of 20% in ship length caused an increase in turning radius, per ship length, of 300%. The absolute turning radius was increased by 366% as compared with that of the shorter model. Hence, the tests predict much higher forces and moments for the longer ship to achieve the same radius turn and, conversely, the ship will only be able to execute a much greater radius turn with the same available turning forces.

The problem of length versus ability to turn in ice is specially acute with ships of the type now used on the Great Lakes and its affect on their difficulties is discussed in the publication *Survey Study for Great Lakes—St. Lawrence Seaway Navigation Season Extension,* Main Report, January 1978, U.S. Army Engineer District, Detroit Corps of Engineers, Detroit, Mich., which is hereby incorporated by reference. The lake ship is designed to maximize the cargo-carrying capacity within the restrictions of the lock sizes within the system. Essentially, this calls for a design incorporating a full bow, long parallel ship sides, and a relatively full stern. Such ships have a length of 600 to 1000 feet and a beam from 56 to 105 feet. This general standard design of lake vessel, although admirably suited for the efficient carriage of bulk cargo throughout the "lakes system" under normal navigating conditions, is not well suited to the conditions encountered in winter on the Great Lakes system. The long parallel body, making it difficult to alter course, when navigating in ice, often prevents a vessel from attempting to navigate in confined water, even though the bow is capable, although sometimes with difficulty, of breaking a channel to enable straightline forward progress to be made.

When the ship is moving straight ahead, the ice is broken by its bow and the unbroken ice tends to hug the sides and develop considerable friction, impeding forward movement. The condition is complicated by the fact that the ice is often "uneven", as a result of channels having been broken and rebroken, with the pieces of ice thrown up into uneven mounds and refreezing in that form. This uneven structure increases the friction and resistance to movement. If straightline movement is difficult, the problem is compounded when the ship tries to turn. In making a turn, under the action of the rudder, the ship pivots about a point about a third of the way from the bow to the stern (this will vary somewhat depending on the design of the vessel and its draft forward as against its draft aft). Bow thrusters are sometimes used to move the bow laterally, but these tend to become fouled in ice and so are not usually employed for winter navigation.

SUMMARY OF THE INVENTION

It is an aim of the invention to provide means for overcoming or, at least, lessening these problems.

This is done, according to the invention, by first breaking a channel in the ice having a width of substantially the normal beam of the ship. Then as the ship advances in the channel, an auxiliary channel is broken at each side of it towards the bow of the vessel, which removes the solid ice and resulting friction on the side of the vessel as it moves forward. Then, when the vessel is steered under forward propulsion in such a manner as to make a turn, and pivoting about a point approximately one-third of its length from the bow, the forward third of the vessel moves in the direction of the turn and into the auxiliary channel provided for leeway on that side of the vessel. Simultaneously, while making forward progress, the stern moves in the opposite direction to that of the bow and makes leeway into the auxiliary channel on the other side of the vessel, which has been preferably enlarged for this purpose and which would otherwise have been closed by unbroken ice.

Preferably, the auxiliary channel is formed by applying force, in a forward, upward and outward direction, against the edge of the ice, causing it to be broken into pieces and cast aside in fragments onto the unbroken layer of ice, leaving in the auxiliary channel beside the ship, open water with floating residual broken pieces of ice whose resistance to the forward or sideways movement of the ship is not to be compared with that of solid ice.

Providing a channel, as described, enables a ship to navigate ice covered waterways, allowing the ship to negotiate bends in which its axis moves through a turn greater than 30° up to about 65° in a distance of about 3000 to 4000 feet with the vessel moving at, say, from one-half mile an hour to four miles an hour. In making turns of the order described, a ship may have to move a total lateral distance (the bow moving in one direction and the stern in the opposite direction) of up to about 1000 feet.

One way of doing this is to provide a ship with means for breaking the ice to each side of the channel already broken in the ice by the bow. This provides auxiliary channels, thus reducing the friction of the surrounding ice on the sides of the vessel and, at the same time, keeps open a channel, extending some distance from each side of the ship. This allows leeway of the ship's sides towards the stern and thus increases its ability to change direction.

Preferably the ship is equipped with opposed ice-breaking means which protrude from each side, just aft of the bow, and which extends diagonally from below to above the waterline so as to break an auxiliary channel extending several feet from each side of the ship, and desirably with a combination of such means with similar means which protrude from each side of the ship towards the stern.

Preferably, these ice-breaking means are in the form of fins protuding from the sides of the ship and which have a forward ice-contacting surface sloping rearwardly from bottom to top, at an angle to the waterline. This surface, on encountering the ice, as the ship moves forward, lifts it, breaks it up and casts it away from the ship's side, leaving the auxiliary channel beside the ship either free of ice or in which the ice is broken up and wet so that it offers a minimum of frictional resistance to the sides of the ship moving past it. The auxiliary channel also provides leeway for the side of the ship to make the sideways movement it has to make to permit the hull to describe a turn.

In one embodiment of the invention the fin is a fixed box-like structure permanently attached, as a protuberance, to the side of the ship. In a preferred structure, a steel doubler plate is welded to the side of the vessel, in a diagonal position. The doubler plate carries the structure of the fin proper which is a hollow channel made up of opposed side plates extending diagonally upwards and inwards to meet a crown plate. End plates close the ends of the structure and spaced-apart stiffeners are welded to the doubler plates, side plates and crown plate. The inside of the side of the ship is reinforced to take up the strain placed on the structure by the ice-breaking action.

In a further embodiment, a permanent structure is built into the side of the vessel from which the fin is movable from a stowed position in which there is no protrusion from the side to an active position in which it protrudes from the side. In these constructions a special sturdy water-tight pocket or compartment is provided for receiving the fin and mechanism for moving it into and out of operative position. In one construction the fin is pivotally mounted and power mechanism, for example, a hydraulic piston, is provided to move it pivotally from stowed to operative position.

In another embodiment, the fin is adapted for straight-line movement out of and into the compartment by power mechanism.

In still another retractable construction, the fin is mounted on a rod or other member which extends from a bracket pivoted to the ship's deck or to the ship's side. A suitably located power mechanism, for example, a hydraulic piston is connected to the rod to move it between inoperative position and operative position. A support for the fin extends from the side of the ship so that the fin is held in operative position against the force of the ice. Desirably the support is retractable, for example, by a hydraulic piston mechanism located in a compartment in the ship's side.

The fixed fin has the advantage of economy in construction and, being mounted on the outside of the ship, is not taking up cargo space. The retractable fin has the advantage that it can be retracted to avoid a protuberance on the side of the ship and not to extend the beam dimension. In certain cases, this construction may be needed to comply with navigation regulations. The detachable type has the further advantage that it can be removed entirely from the ship and does not take up any cargo space.

BRIEF DESCRIPTION OF THE DRAWINGS

Having thus generally described the invention, it will be explained more specifically by reference to the accompanying drawings which illustrate preferred embodiments, and in which:

FIG. 5 is a fragmentary side elevation of the foward section of a ship having a particular bow construction advantageous for breaking ice, used in conjunction with fins according to the invention;

FIG. 6 is a fragmentary perspective view of the side of a ship equipped with a stationary form of fin according to the invention;

DESCRIPTION OF THE PREFERRED EMBODIMENTS

To illustrate the problem encountered in winter navigation by ships of the type used on the Great Lakes, reference is made to the Corps of Engineers Survey Study for Great Lakes—St. Lawrence Seaway Navigation Season Extension, referred to above.

Figure 1:
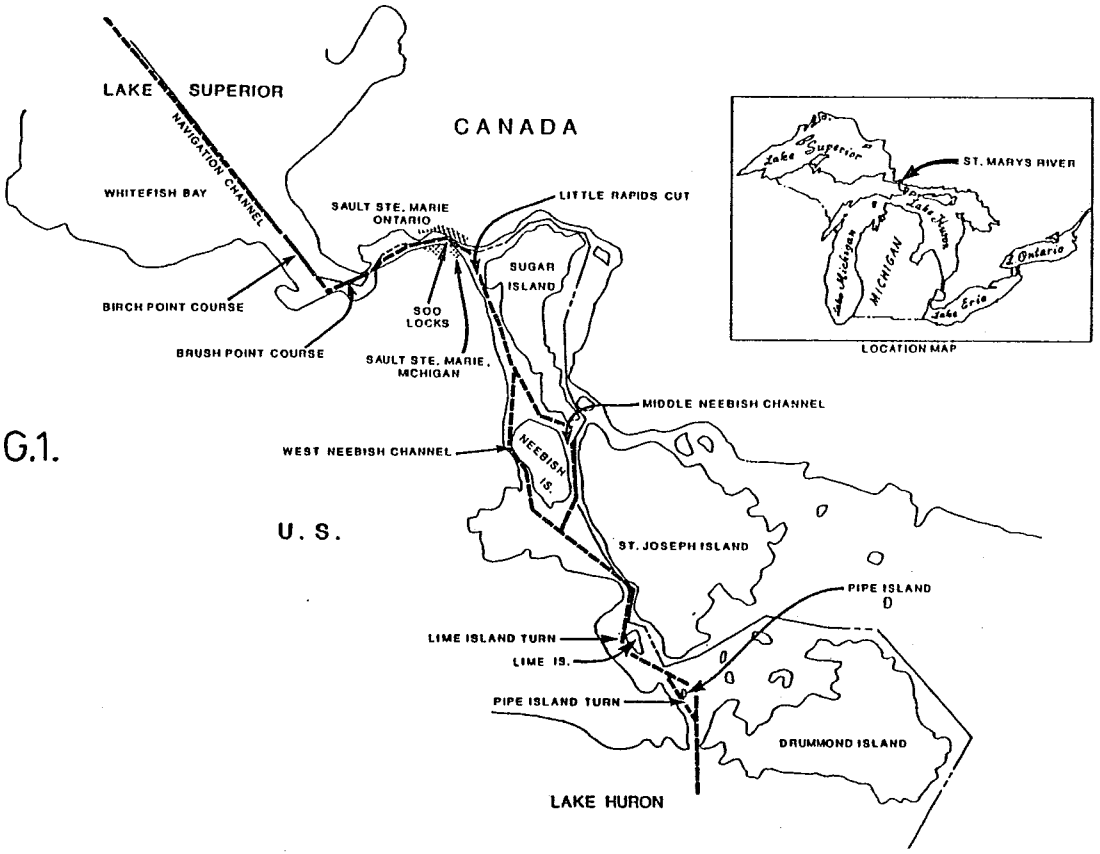
FIG. 1 is a map showing the typical sharp turns a lake boat has to make in navigating the Great Lakes waterway.

FIG. 1 is a map, used in the Survey, in analyzing the problem of ice navigation through the St. Marys River. This is a difficult stretch of water, as far as turns are concerned, which joins Lake Superior with Lake Huron, in the vicinity of Sault Ste Marie. It is frozen over during the winter months. In the map, the U.S./Canadian boundary is shown in chain lines and the navigation track in dash lines.

The map shows that there is a series of sharp bends in the channel which make frequent tight turns necessary. These bends are identified on page B-19 of the Survey as Whitefish Bay (Birch Point Turn), Middle Neebish Channel, Angle Course 5 & 6, Angle Course 6 & 7, Angle Course 8 & 9, Angle Course 9 & 10, Lime Island Turn, and Pipe Island Turn.

In negotiating these turns a typical lake ship of 600 to 1000 feet in length has to move through angles of up to 65° in a longitudinal distance of not more than 4000 feet.

The St. Marys River is some 45 miles in length and includes at least 15 turns. The present way of dealing with the problem is to make ice-breaker assistance available. However, although this assistance is available throughout the winter, it may take several hours, after receiving a call for help, for the ice-breaker to reach the site. So, it is not unusual to see a lake vessel manoeuvering for an hour or two to make a turn at one of the bends. Often, the vessel is unable to complete the turn and must wait for the ice-breaker.

Having regard to this problem, the Survey, which is relatively recent (January 1978) suggests, as the most promising solutions, an air bubble system, ice-breaking assistance, or enforcing minimum vessel ice-breaking capability.

Another system which is actually quite effective is to weaken the ice by sprinkling, on the surface, a heat-inducing substance like carbon black, to cause melting. But, this has environmental drawbacks. Suggestions have also been made to modify the ships themselves, but the suggested modifications are not practically applicable to the present problem.

The invention provides practical means of coping with the problem of a lake ship to navigation in ice covered waters, particularly where frequent changes and direction are necessary.

Figure 2:
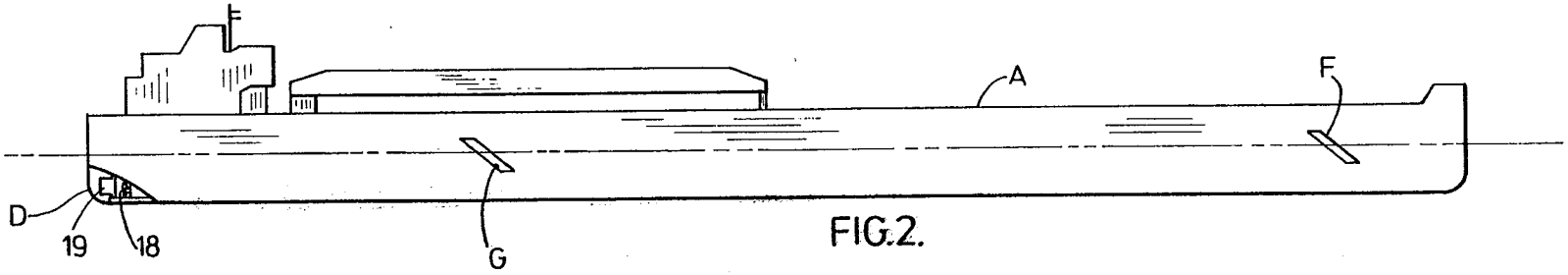
FIG. 2 is a side elevation of a lake boat equipped according to the invention.
Figure 3:
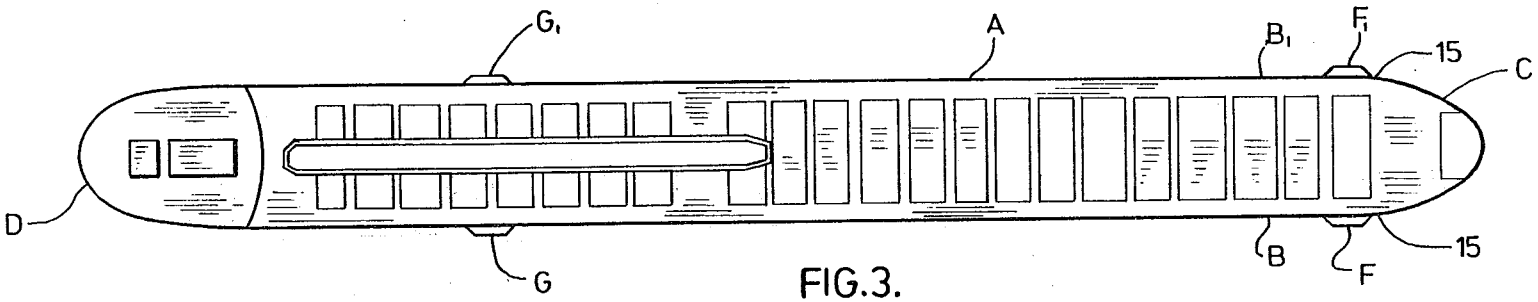
FIG. 3 is a plan view of the boat shown in FIG. 2.

FIGS. 2 and 3 illustrate a typical lake boat whose hull has elongated port and starboard sides respectively. The sides B and $B_1$ converge, at the forward end of the ship, starting at transition points 15 so as to form a wedge-shaped bow indicated generally by C. At the stern end of the vessel the sides B and $B_1$ converge to form a rounded stern indicated generally by D. The ship is driven by propellers 18 and steered by rudders 19. The propellers on the typical lake ship are powered by an engine (not shown) capable of propelling the ship at speeds up to about 13 to 17 miles per hour on open water.

The total length of a ship of this type usually ranges from about 600 to about 1000 feet with a beam from about 56 to about 105 feet. Navigating through circuitous channels, a ship has to make turns of the order mentioned above where the axis of the ship has to move through a considerable angle in a limited distance. Even in open water, such turns are fairly difficult to execute. And, with a normal vessel breaking ice only with its bow the frictional resistance in the forward movement coupled with the direct resistance of the sheet of ice, possibly built up with amounts of refrozen ice, broken out to form a channel for the previous passage of a ship, makes the execution of a turn extremely difficult, and in some cases impossible, as discussed in the Survey Study. Having regard to this discussion of the problem, the nature of the present invention in solving the problem will be described.

The invention is based on the concept of first forming a channel in the ice having a width corresponding to the normal beam of the ship, and then forming, prior to the entry of the body of the ship into the main channel, auxiliary channels at each side and preferably as the ship turns using the leeway permitted by the auxiliary channel opposite to the direction of the turn, enlarging the auxiliary channel towards the stern of the ship so as to provide additional leeway. Preferably, the auxiliary channel is formed by directing against the ice at the side of the main channel, means which exerts a forward and upward force breaking the ice into pieces with a lifting section and scattering the pieces to one side, for example, on the surface of the unbroken ice.

To this end, in accordance with one aspect of the invention, the ship is provided with forward ice fins F and $F_1$ respectively and the rear part of the ship with after ice fins G and $G_1$ respectively.

Figure 4:
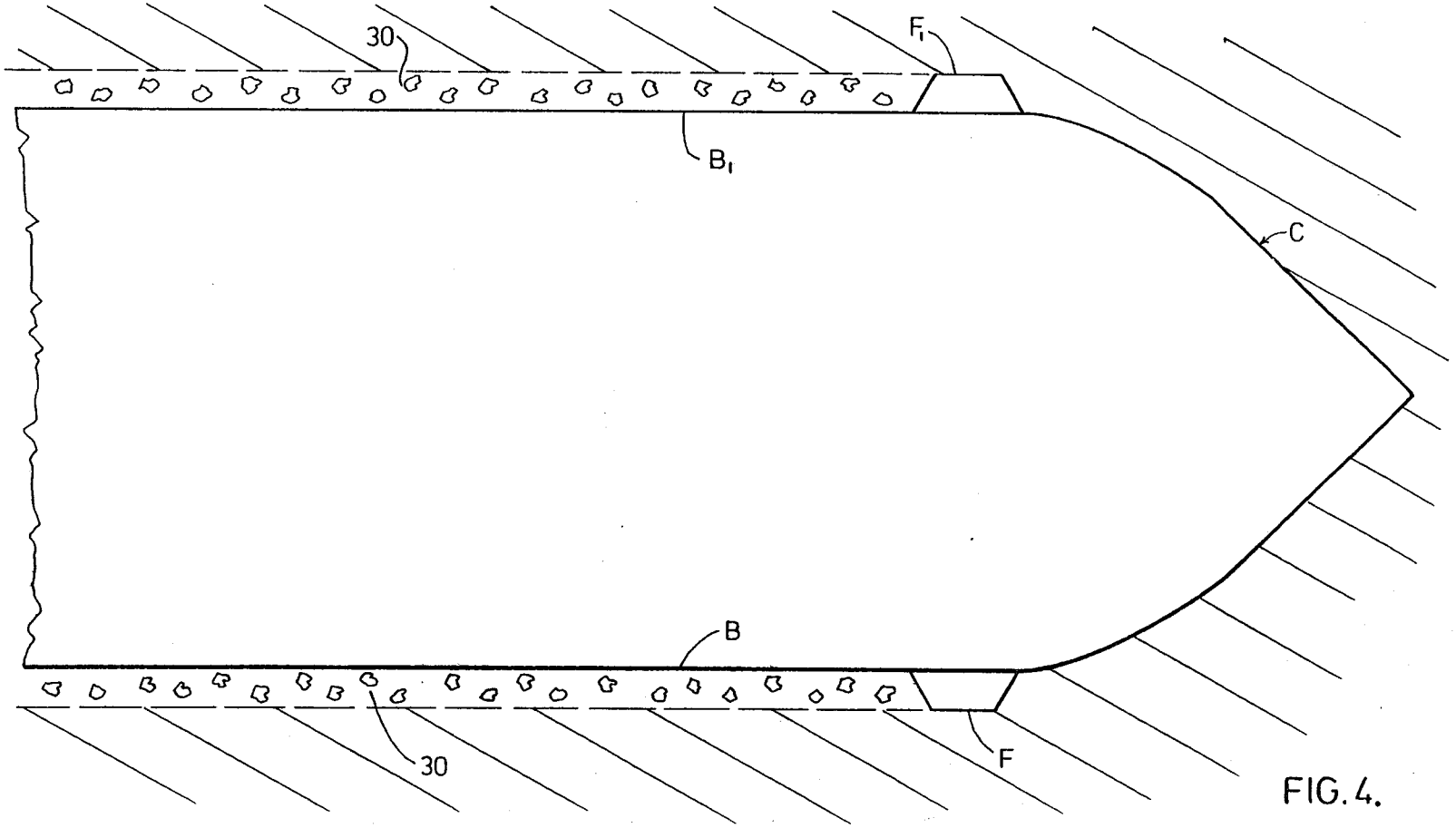
FIGS. 4 and 4*a* are greatly enlarged plan views of the force and aft sections respectively of the lake boat FIG. 2 showing particularly the relationship of the sides of the vessel to the surrounding ice.
Figure 4A:
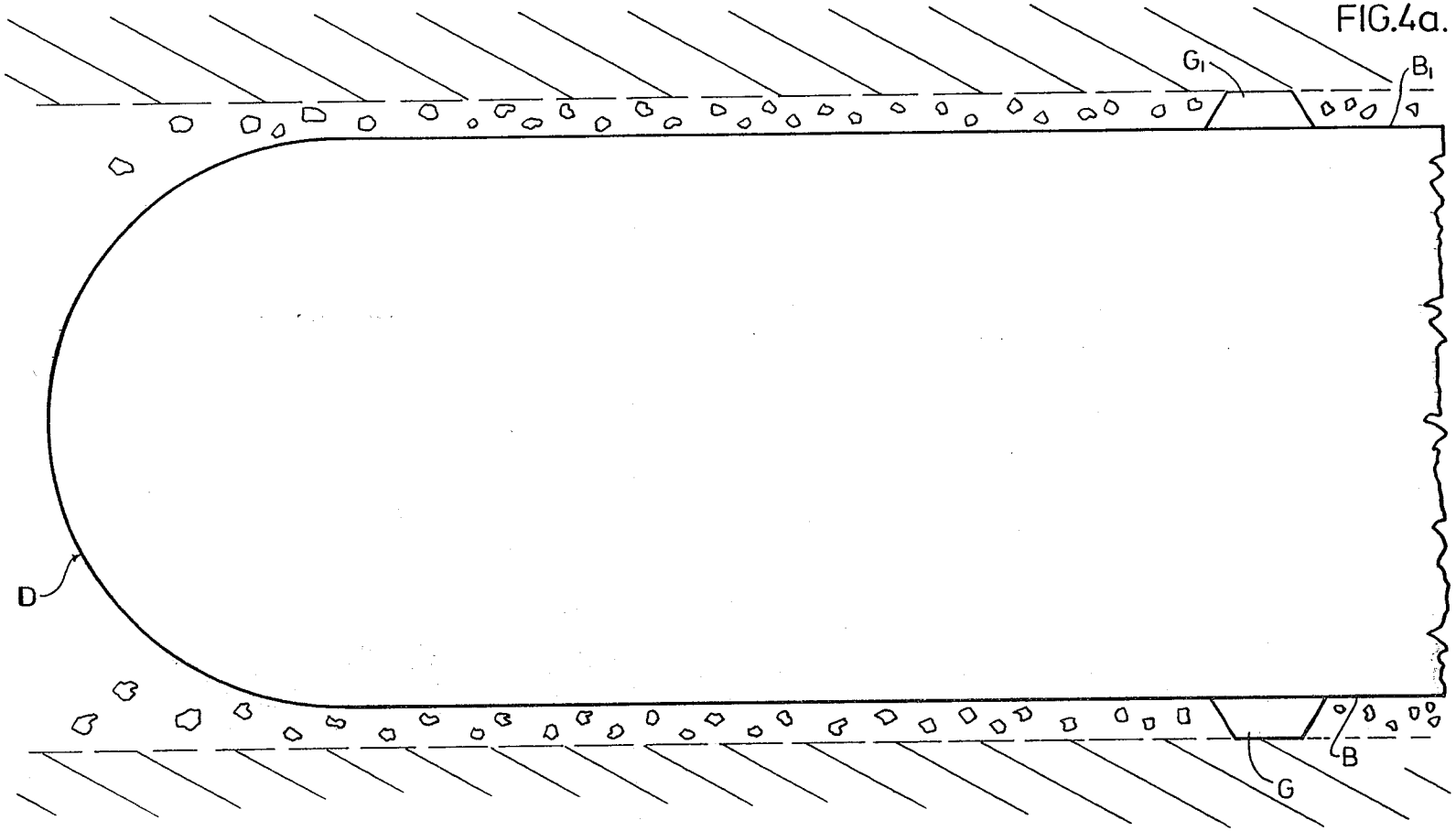

FIGS. 4 and 5 show the mounting of a permanent fin F. A one inch steel doubler plate 21 is welded to the side of the vessel in the diagonal position shown. The doubler plate carries the structure of the fin proper, which is a hollow channel, made up of opposed side plates 23 extending diagonally upwards and inwards to meet a crown plate 25. End plates 27 close the ends of the structure. Stiffeners 29 are welded to the doubler plate 21, to the side plates 23, and to the crown plate 25 respectively. The entire structure is made up of steel plates welded together in the form of a strong box structure. The inside of the side beam may be reinforced, in the vicinity of the fins, by bracing structure of a type known in ship construction, to take up the strain placed on the side by the ice.

In a typical fin, the crown plate would have a dimension of about two feet across with the other part proportionate. In the particular construction shown, the fin is at an angle of about 45° to the waterline, but this may vary as described. The construction has been shown as quadrangular but it could be rounded. For example, the leading face 23 could describe an arc presenting a receding surface for engaging and casting off the ice or the fin may be triangular in cross-section.

OPERATION

The operation of the vessel in clearing an ice path through a surface covered with unbroken ice is as follows.

As the ship advances the relatively sharp reinforced point of the bow C breaks the solid sheet of ice K which is fragmented into pieces by the impact and forced to each side of the bow, forming a channel as wide as the bow. At the same time, the fins F and $F_1$ encounter unbroken ice, at each side of the channel broken by the bow, and force this ice upwards and outwards, thus forming an auxiliary channel 30 about the width of the fin at each side of the ship. The channel 30 contains broken ice and its outer limits are defined by unbroken ice beyond the fins and spaced from the side of the ship.

When the ship makes a turn, it pivots around a point about a third of the way from the bow to the stern and sternwards from that point the vessel has to move sideways into the auxiliary channel 30. At the same time, the forward movement of the ship enables the after fins G and $G_1$ to engage the ice and perform a similar function as described in connection with the forward fins F and $F_1$.

There are some ships on which the entire bow portion has a wider beam at the bow than at midships, in effect to provide opposed fins protruding from the sides proper of the ship. In this case, the bow performs the same function as the forward fins F and $F_1$ and the after fins G and $G_1$ cooperate with it in clearing a channel towards the stern of the ship to facilitate its lateral movement in turning.

The forward speed of the ship during turning will vary depending on a number of factors but is usually in the range from about 2 to 4 miles an hour or is sometimes slowed to ½ mile an hour, depending on the ice conditions.

Figure 8:
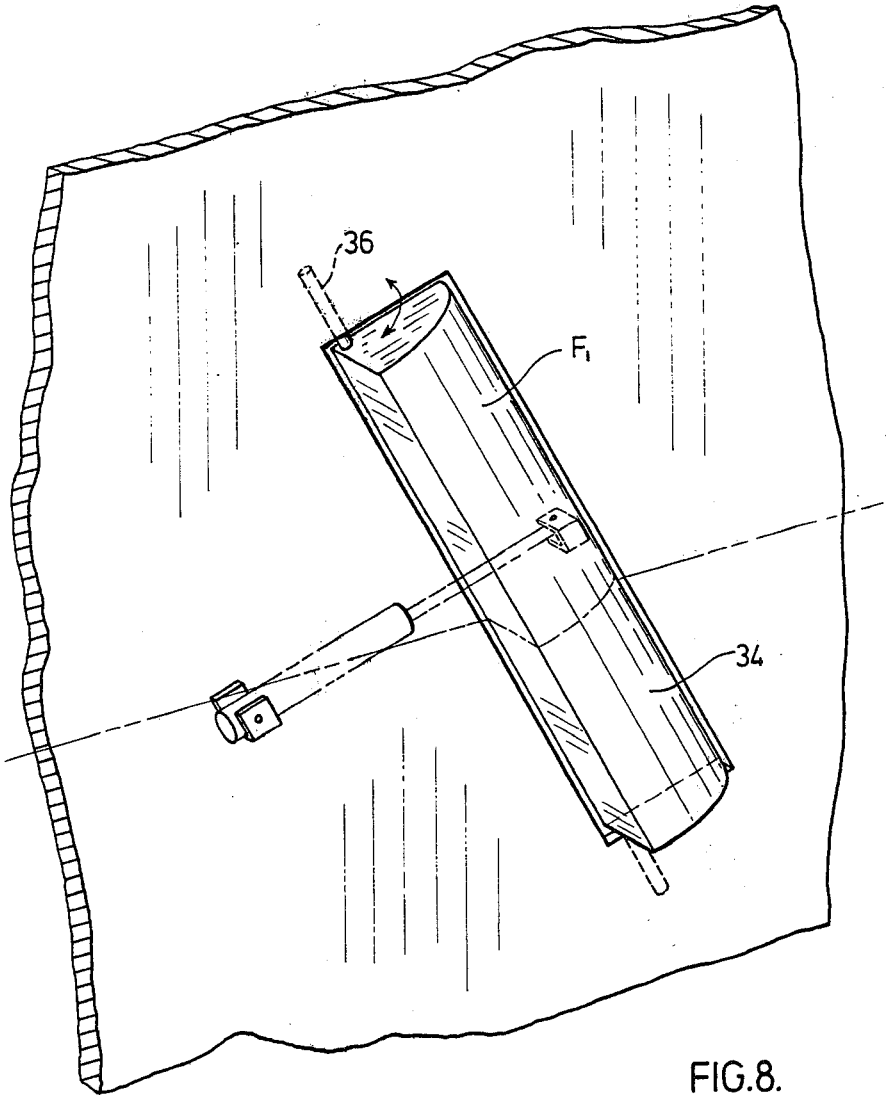
FIG. 8 is a fragmentary perspective view of the side of a ship equipped with another preferred form of retractable fin, according to the invention, in this case retractable.
Figure 9:
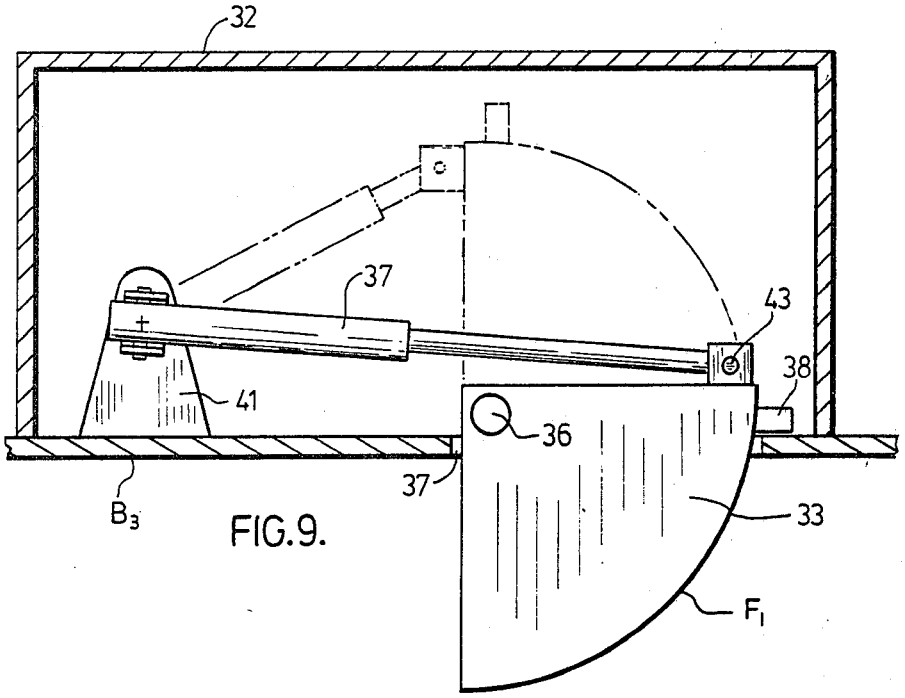
FIG. 9 is a fragmentary horizontal cross-section on a further enlarged scale showing the operation of the retractable fin of FIG. 8.

FIG. 8 shows an alternative embodiment of the invention, in this case a retractable fin $F_1$.

A water-tight box 32 is connected to the inside of the ship side $B_3$ and communicates with an opening 37 in the side $B_3$ through which the fin $F_1$ may be moved between the stowed position (dotted lines) and operative position (full lines) as shown.

The fin $F_1$ has a body 33, having a cross-section, as shown, with a curved wedging face 34, and mounted on a pivot 36. The body 33 is mounted by a suitable connection 35 to the side $B_3$. A hydraulic cylinder and piston arrangement 37 is pivotally connected to the box 32 through a pedestal 41 and to the body 33 as at 43, so that the piston can move the fin between stowed and operative position through the opening in the side of the ship.

This construction, although more complex and costly than the fixed construction shown in FIGS. 2 to 5, may be required where the beam of the ship must be kept to a certain maximum, or where the navigation regulations, for example, in the locks, do not permit a structure to protrude from the side of a ship.

Figure 7:
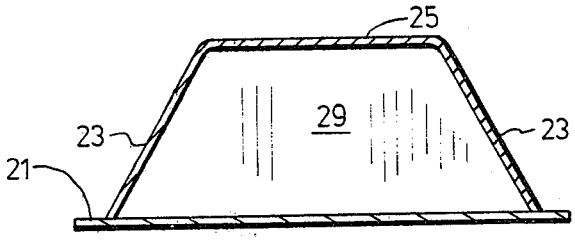
FIG. 7 is a cross-section along the lines 7—7 of FIG. 6.
Figure 10:
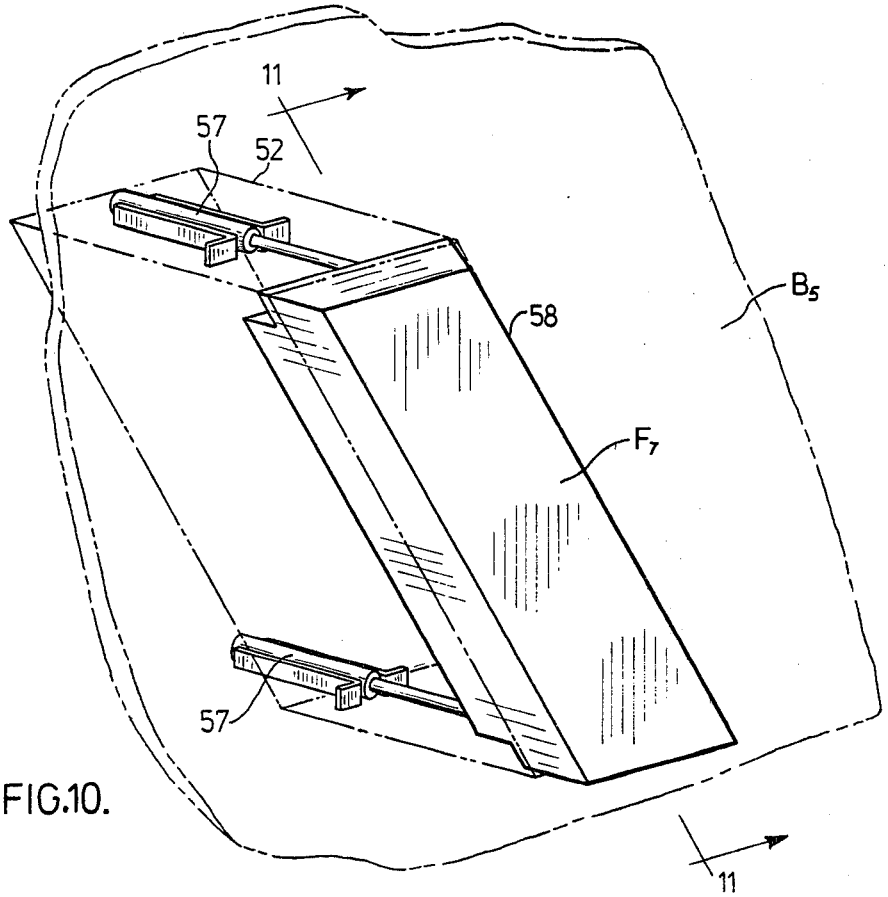
FIG. 10 is a diagrammatic fragmentary perspective view of the side of a ship equipped with another form of retractable fin, according to the invention.
Figure 11:
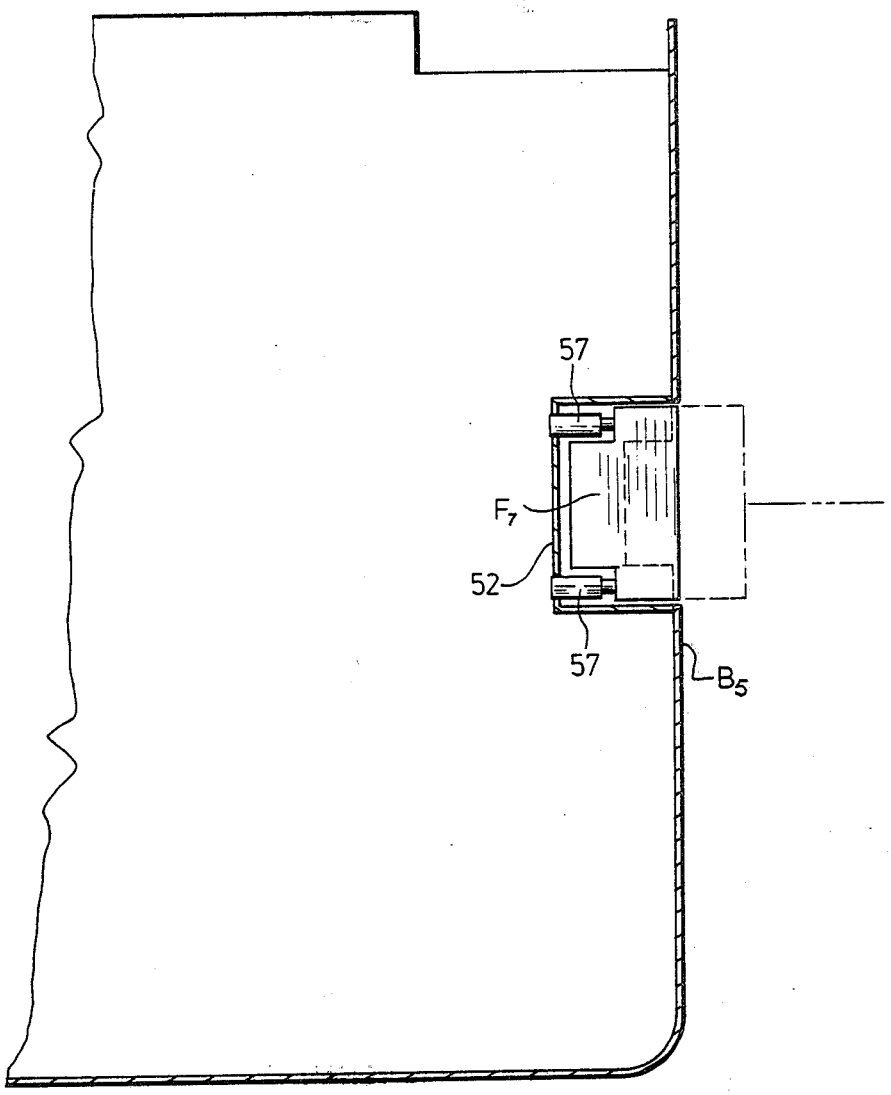
FIG. 11 is a vertical cross-section as along the line 11—11 of FIG. 9.

FIGS. 10 and 11 show another construction of retractable fin $F_7$. As in the version shown in FIGS. 6 and 7, there is a box 52 into which the fin $F_7$ is stowed and from which it is moved into operative position by a hydraulic piston arrangement 57 through to an opening 58 in the side $B_5$ of the ship. The opening is at a desired angle to the waterline so that the fin is diagonal to the waterline as described in connection with the embodiment of FIGS. 2 to 5.

Figure 12:
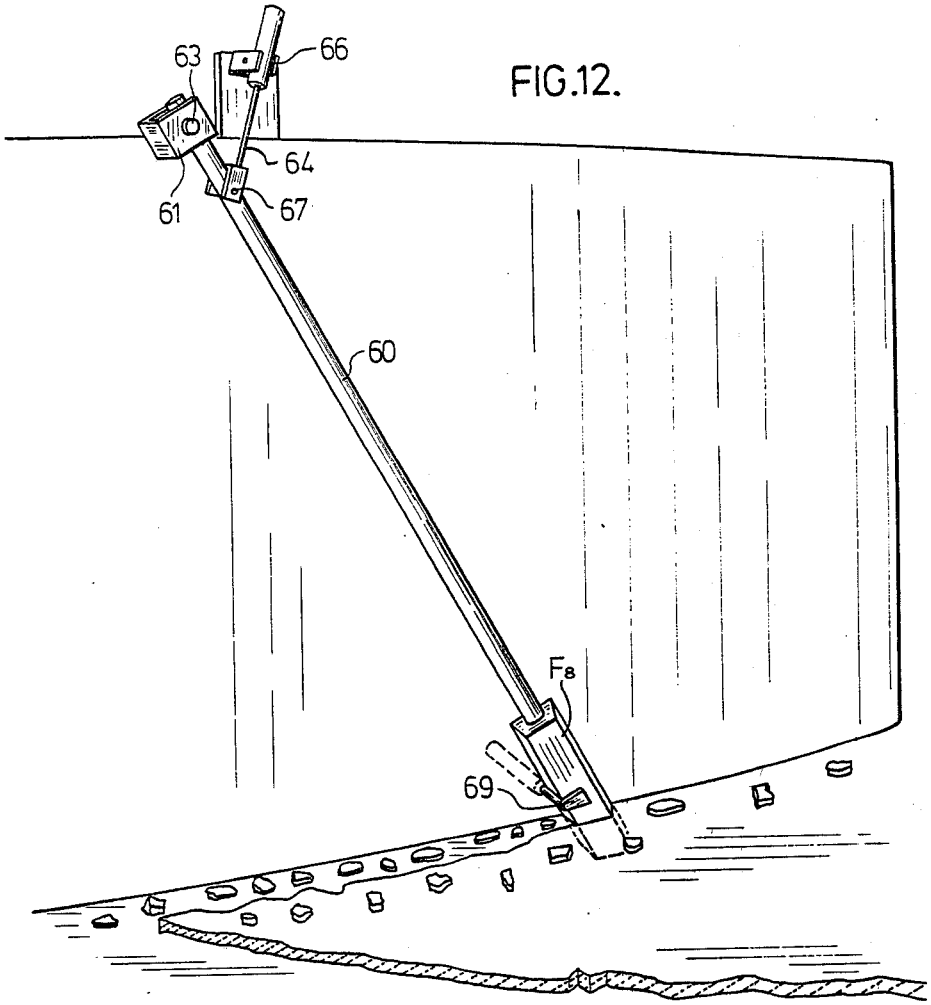
FIG. 12 is a fragmentary perspective view of the side of a ship equipped with still another form of fin, according to the invention, in operative position acting on a layer of ice.
Figure 13:
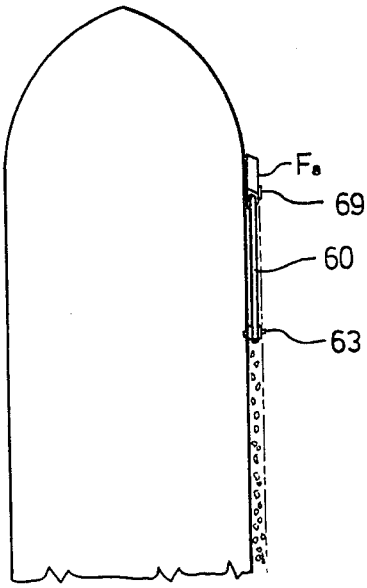
FIG. 13 is a plan view of the form shown in FIG. 12.
Figure 14:
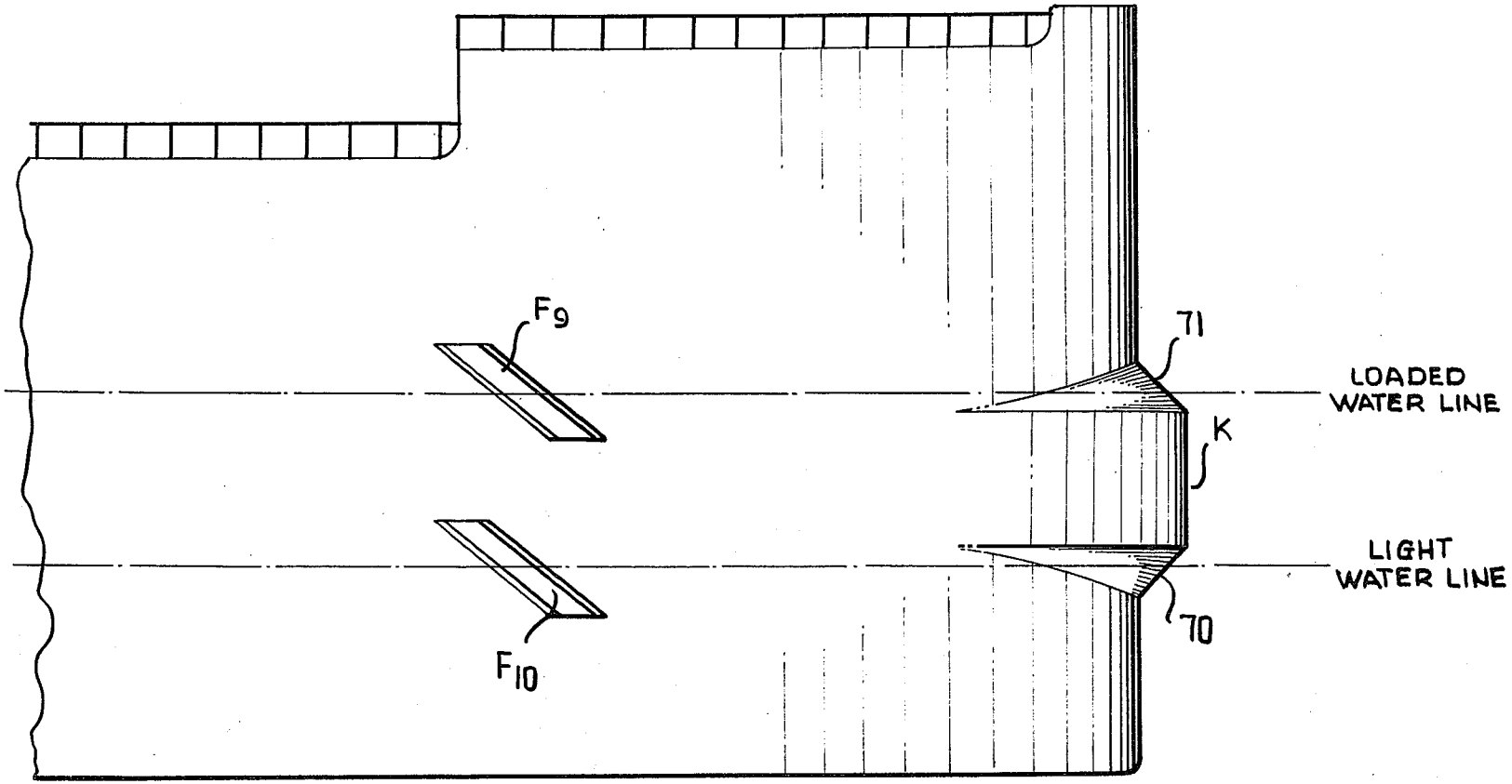
FIG. 14 is a fragmentary side elevation, similar to FIG. 5, but showing vertically spaced-apart fins for acting when the ship is loaded and when it is light respectively.

FIGS. 12 through 14 illustrate still another form of retractable fin $F_8$, according to the invention. In this case, the fin $F_8$ is mounted on a rod 60 which extends from a bracket 61 pivoted as at 63 to the ship's side. A cylinder and piston arrangement 64, mounted on a super-structure 66 on the deck, is pivotally connected as at 67 to the rod 60 so as to move it from stowed position to operative position. A stop 69 is provided to engage the fin $F_8$ and retain it in operative position.

FIG. 5 shows a modification of the bow structure of the vessel, which is particularly effective in combination with fins according to the invention. In this case, the lower part of the bow of the vessel is provided with a protruding part K which has an upwwardly sloping undersurface 70 and an upwardly sloping uppersurface 71. The surface 71 is located at the waterline so that it engages the ice and exerts a lifting action on it which is advantageous to breaking it up. As the bow moves further into the channel formed by it, the sides of the ice are engaged by the fin $F_9$ and the action, which has been described previously, takes place to open up an auxiliary channel.

VARIABLE FACTORS

Among the variable factors affecting the invention are the following.

Ships to which the invention apply usually have a length from 600 to 1000 feet and a beam from 56 feet to 105 feet. The sides are usually made of steel plate running from ¾ of an inch to ⅞ of an inch thick. The fins should protrude far enough from the ship's side to break the ice and reduce friction against the ship's side. A fin will have a working thickness, i.e. will project from the ship's side, from about 1 foot to about 4 feet with 2 to 3 feet preferred. The fin will be angled to the waterline, to lift the ice or push it down, with even small angles from 80° to the horizontal being effective, although a desirable range of angle is between about 30° to about 60° to the vertical, with 40° to 50° preferred. The position and length of the fin should be such that, when the ship is light, it extends at least about 2 feet below the ice surface, and, when the ship is loaded, it extends at least about 1 foot above the ice surface. This means that the height of the fin, measured vertically, will be from about 12 feet to about 16 feet. Two sets of fins may be employed, one placed to operate when the ship is in ballast, and the other when loaded. In this event, the fins could be shorter. The width of the fin is preferably from about 2 to about 3 feet. This form of the invention is shown in FIG. 14. An upper fin $F_9$ is shown traversing the loaded water line, the lower fin $F_{10}$ is shown traversing the light water line.

The construction of the fin may vary widely but must be capable of withstanding the impact of the maximum ice thickness encountered. The ice usually runs from about 1 foot to about 2 feet.

The forward fins are placed at the forward end of the parallel body close to the transition point where the bow reaches the maximum beam. Rearward fins may be placed at any point from midship to the after-most part of the vessel where it has a maximum beam, preferably between 0.6 and 0.8 of the entire length of the ship, measured from the stem of the bow. While the invention is operative with a forward set of fins only, it is preferable to also have at least one set of after fins.

Where the fins are installed in a new ship as is being built, accommodation can be made for strengthening the sides in the neighbourhood of the fins. For installation in an existing vessel, it is desirable to put doubler plates on the outside of the sides. In the case of the retractable fins, the side of the ship is cut to provide an access opening and suitable reinforcing provided on the inside. The installation must be such as to occupy a minimum space so as not to interfere with cargo.

I claim:

1. A ship having a hull of length from about 600 to about 1000 feet provided with straight substantially vertical elongated sides tapering inwards, at one end, into a pointed bow normally adapted, with the forward motion of the ship against an ice covering of a waterway, to break a channel in said covering equivalent to the normal width of the ship to allow the ship to move forward, a bulky icebreaking fin mounted to project outwards from each straight side just behind the bow with a fixed continuous deflecting surface extending from below to above the waterline at a sternward angle of from 10° to 60° from a line perpendicular thereto and along its length a sternward incline thereby, with the advance of the ship to apply forward, upward and outward pressure on the ice beside the main channel to break an auxiliary channel thereby to provide leeway for the ship to move forward through the ice and to execute turns, the fin having a fore to aft width from about 2 feet to about 3 feet and an effective thickness measured out from the ship's side of from about 1 foot to about 4 feet.

2. A ship, as defined in claim 1, in which the icebreaking means includes an elongated pocket in the ship's side extending diagonally from below to above the waterline, and said fin is mounted for movement between stowed position within the pocket and active position projecting from the ship's side, and power means for moving the fin between said positions.

3. A ship, as defined in claim 2, in which the fin is pivotally mounted on the ship's side and there is a piston mechanism within said pocket connected to the fin and to an operating cylinder respectively for moving the fin into and out of operative position.

4. A ship, as defined in claim 2, in which the fin is movable in a linear direction into and out of operative position and power means for moving the fin.

5. A ship, as defined in claim 1 or 2, in which the fin is arranged to present an active surface angled from about 40° to about 50° from perpendicular to the waterline.

6. A ship, as defined in claim 1, in which the fin has a height measured perpendicular to the waterline of from 12 to about 16 feet.

7. A ship, as defined in claim 1, in which the icebreaking means includes an elongated rod pivotally mounted at the ship's side and an elongated fin mounted on the end of said rod, power means for moving said rod between active position in which the fin traverses the waterline in ice-breaking position and a retracted position in which the fin is away from the waterline, and retractable stop means extensible from the ship's side to engage said fin and hold it in ice-breaking position against the pressure of the ice.

8. A ship, as defined in claim 1, in which the fin comprises a box structure made up of a base plate mounted on the ship's side, a pair of converging side plates extending diagonally outward therefrom to meet a crown plate joining their edges from end plates between the side plates, crown plate and base plate, and reinforcing plates spaced-apart between the end plates and connected to the side plates, crown plate and base plate.

9. A ship, as defined in claim 1, in which the icebreaking means is a narrow elongated fin carried by the end of a rod pivotally mounted from the ship's side for movement of the fin into ice-breaking position and for retraction to inactive position above the waterline.

10. A method of moving lake ships through an icebreaking covered waterway including bends requiring sharp turns, comprising:

propelling the ship forward under power and causing the bow to break a channel in the ice the width of the ship's beam, and continuously as the ship moves forward acting on the ice on the edge of the main channel just aft of the bow with forward, upward and outward force thus breaking the ice and casting it aside in fragments to provide an auxiliary channel for reducing friction on the sides of the vessel facilitating its forward movement and to permit leeway in making turns, powering the ship forward and steering it to make turns causing the sides to move into the auxiliary channel.

11. A method, as defined in claim 10, in which there is exerted on the edge of the auxiliary channel towards the stern of the ship as it is advancing forward, upward and outward force thereby enlarging the auxiliary channel further to facilitate the sideways movement of the vessel in executing the turn.

12. A ship having a hull of length from about 600 to about 1000 feet provided with straight substantially vertical elongated sides tapering inwards, at one end, into a pointed bow normally adapted, with the forward motion of the ship against an ice covering of a waterway, to break a channel in said covering equivalent to the normal width of the ship to allow the ship to move forward, a bulky fin mounted on each side just behind the bow and on each side at a point between about 0.6 and 0.8 of the entire length of the ship, measured from the stem of the bow, to apply forward, upward and outward pressure on the ice beside the main channel to break auxiliary channels providing leeway for the ship to move laterally to execute a turn, each fin being arranged to present an active surface angled in the up and down direction from about 10° to about 60° from perpendicular to the waterline, each fin having a width of about 2 to about 3 feet and a projection from the ship's side from about 1 foot to about 4 feet and extending in the up and down direction a distance to reach at least about 1 foot above where the ice surface would reach and at least about 2 feet below where the ice base would reach.

13. A ship having a hull of length from about 600 to about 1000 feet provided with straight substantially vertical elongated sides tapering inwards, at one end, into a pointed bow normally adapted with the forward motion of the ship against an ice covering of a waterway to break a channel in said covering equivalent to the normal width of the ship to allow the ship to move forward, a bulky icebreaking fin mounted on each side just behind the bow and another fin mounted on each side at a position to the stern between 6/10ths and 8/10ths of the length of the ship measured from the stem of the bow, each fin having a continuous deflecting surface extending from below to above the waterline at a sternward angle and the deflecting surface having along its length a sternward incline thereby with the advance of the ship to apply forward, upward and outward pressure on the ice beside the main channel to break an auxiliary channel providing leeway for the ship to move forward through the ice and to execute turns.

14. A ship having a hull of length from about 600 to about 1000 feet provided with straight substantially vertical elongated sides tapering inwards, at one end, into a pointed bow normally adapted with the forward motion of the ship against an ice covering of a waterway to break a channel in said covering equivalent to the normal width of the ship to allow the ship to move forward, a pair of bulky icebreaking fins mounted on each side just behind the bow, each having a continuous deflecting surface at a sternward angle in the up direction and having along its length a sternward incline thereby to apply forward, upward and outward pressure on the ice beside the main channel to break an auxiliary channel providing leeway for the ship to move forward through the ice and to execute turns, the fins being mounted so their deflecting surfaces extend from below to above the waterline of the ship when loaded and in ballast respectively.

15. A ship, as defined in claim 13 or 14, in which each fin has a fore to aft width from about 2 feet to about 3 feet and an effective thickness measured out from the ship's side of from about 1 foot to about 4 feet.

16. A ship, as defined in claim 13 or 14, in which the sternward angle of the deflecting surface is from about 10° to about 60° from a line perpendicular to the waterline.

17. A ship, as defined in claim 13 or 14, in which each fin has a fore to aft width of from about 2 feet to about 3 feet and an effective thickness measured out from the ship's side of from about 1 foot to about 4 feet, and in which the sternward angle of each deflecting surface is from about 10° to about 60° from a line perpendicular to the waterline.

* * * * *